United States Patent [19]

Stanevich

[11] Patent Number: 4,960,386

[45] Date of Patent: Oct. 2, 1990

[54] HIGH DEFLECTION, HIGH DENSITY SINGLE SIDED ELECTRICAL CONNECTOR

[75] Inventor: Kenneth W. Stanevich, New Baltimore, Mich.

[73] Assignee: Molex Incorporated, Lisle, Ill.

[21] Appl. No.: 422,704

[22] Filed: Oct. 17, 1989

[51] Int. Cl.[5] ..... H01R 13/00

[52] U.S. Cl. ..... 439/326

[58] Field of Search ..... 439/326

[56] References Cited

U.S. PATENT DOCUMENTS

| | | | |
|---|---|---|---|
| 4,136,917 | 1/1979 | Then et al. | 439/326 |
| 4,575,172 | 3/1986 | Walse et al. | 439/326 |
| 4,737,120 | 4/1988 | Grabbe | 439/326 |
| 4,826,446 | 5/1989 | Juntwait | 439/326 |

*Primary Examiner*—Joseph H. McGlynn

*Attorney, Agent, or Firm*—Louis A. Hecht; Stephen Z. Weiss; Charles S. Cohen

[57] ABSTRACT

This specification discloses a zero or low insertion force single or multiple contact electrical connector with single sided spring contacts with inherent high deflection contact capability upon insertion of a printed circuit board into the connector. The connector comprises a plurality of spring single sided contacts generally rectangularly shaped mounted in slots formed along an elongated cavity in a connector housing. Each contact pair includes a single sided deflectable contacting portion for engaging the conductive strips disposed on opposite sides of the insertable edge of the printed circuit board. The opposed contacting portions define an opening through which the edge of the printed circuit board may be inserted in the cavity with zero or low insertion force. Subsequently the printed circuit board is pivoted or rotated through an angle into a final contacting position, in which position the conductor strips on the printed circuit board engage and deflect the contacting portions of the spring contacts with a relatively high contact force. A staggered, alternating pattern of conductive pad contacts on both sides of the printed circuit board yields up to doubling of the number of contacts in a given amount of space along the edge of the board as compared to contacts having traditional double-sided contacts that grip both sides of the board.

9 Claims, 2 Drawing Sheets

HIGH DEFLECTION, HIGH DENSITY SINGLE SIDED ELECTRICAL CONNECTOR

BACKGROUND OF THE INVENTION

1. Field of the Invention

The present invention relates to a zero or low insertion force electrical connector for connecting one printed circuit board to another. More particularly, this invention relates to a zero insertion force connector that yields greater densities and that allows greater deflection of the connector contacts.

2. Prior Art

There are many types of electrical connectors in the prior art for making electrical connections to conductive strips dispersed along opposing sides on the elongated edge of a printed circuit board. One such type is called a "zero insertion force" connector, which allows a circuit board to be inserted into the connector without any substantial insertion force. The board is thus inserted into the connector to make an electrical connection without any urging and potentially harmful friction force against the delicate electrical contacts on the opposing sides of the edge of the board.

Examples of these types of connectors are shown in U.S. Pat. Nos. 3,701,071, 3,795,088, 3,920,303, 3,848,952, 4,176,917, and 4,575,172. While these prior art connectors have provided low insertion force connectors for printed circuit boards, they have deficiencies.

One problem is the limited beam deflection these connectors allow. These prior art connectors have typically employed C- or U-shaped contacts supported by a central attachment point. Depending on the location of the attachment joint, one or the other or both of the two contact arms have a shortened beam length. This shortened beam length limits the range that the contact can deflect without plastic deformation of the contact. Since many boards are or become warped through use, the limited deflection allowed by such a connector limits the utility of the connector for some significantly warped boards.

Another problem with the prior art connectors is the limited density of the electrical connections the connectors can accommodate between the boards they connect. C- or U-shaped contacts necessarily grip the board on two sides. This means one contact, i.e., one electrical connection, occupies a certain amount of contact pad space on both sides of the board. Since adjacent contact pads must be separated by a certain minimum distance given technological constraints, C-or U-shaped connectors cannot achieve a greater density than minimum distance allowed between contacts on one side of the board.

OBJECTS OF THE INVENTION

It is therefore an object of this invention to provide a zero or low insertion force connector that accommodates boards that are warped to a degree that would not be easily or adequately received by a C-or U-shaped zero-insertion-force connector.

Another object is to provide such a connector by allowing greater deflection of the contact arms while maintaining sufficient contact pressure to obtain an effective electrical connection.

Yet another object is to provide a zero or low insertion force connector that provides for greater densities of contacts than allowed by the traditional C-or U-shaped connectors.

A further object is to provide such a connector that can alternately provide single density connections (on one side of a board) or double density connections (utilizing contact pads on both sides of the board, with twice the density of single density connections).

A still further object is to achieve one or more of the foregoing objects in an economical design that uses as much existing tooling, as many existing assembly techniques, and as little material as possible.

There are other objects and advantages. They will become apparent as the specification proceeds.

SUMMARY OF THE INVENTION

The foregoing and other objects and advantages are achieved by the present connector which has a plurality of high deflection, single sided spring contacts. The single sided contacts are mountable as opposing pairs to engage contact pads on the opposing sides of a printed circuit board. The spring contacts preferably have an extended cantilever beam length, allowing for high deflection while maintaining proper contact pressure between the spring contact and contact pad on a circuit board.

BRIEF DESCRIPTION OF THE DRAWINGS

The preferred embodiment of the present invention is shown in the accompanying drawing wherein.

DETAILED DESCRIPTION OF THE PREFERRED EMBODIMENTS

Figure 1:
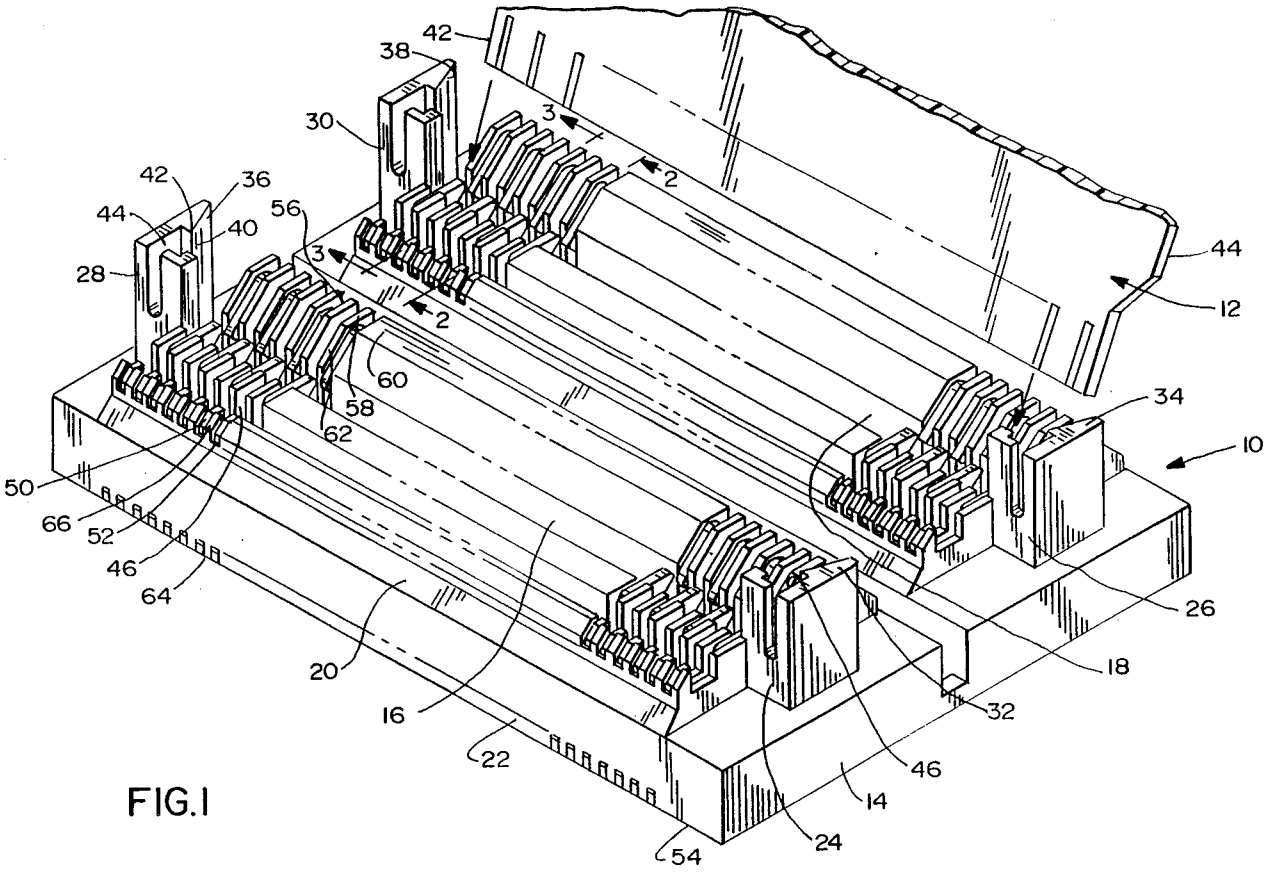
FIG. 1 is a perspective view of preferred embodiment of the electrical connector as used to connect to a printed circuit board.

Referring initially to FIG. 1 of the drawing, the preferred embodiment of the electrical connector, generally 10, is used to connect a conventional printed circuit board, generally 12, to a base circuit board (not shown) on which the connector 10 is mounted. The electrical connector 10 is suitable to connect a single printed circuit board 12 or a plurality of two or more such printed circuit boards to a base circuit board.

The electrical connector 10 includes an elongated housing 14, formed from any suitable insulating thermoplastic, having a pair of elongated, spaced part, board access cavities 16, 18 on the access side 20 of an elongated base 22 in the housing 14. Four upstanding circuit board retention posts 24, 26, 28, 30 extend outwardly from the access side 20. Two of the posts 24, 28 are at opposing ends of the first access cavity 16, and the other two 26, 30 are at opposing ends of the second access cavity 18. Each of the posts 24, 26, 28, 30 includes an integrally-formed, resilient or yieldable board latch 32, 34, 36, 38 formed at the upper end of the posts 24, 26, 28, 30 respectively. The board latches 32, 34, 36, 38 yieldably retain a printed circuit board in a mounted contact position between associated pairs of the posts 24, 28 and 26, 30.

More specifically, each latch, 36 for example, has an elongated tapered surface 40 formed at its free end opposite the access side 20 of the elongated base 22. The tapered surface 40 is outwardly deflectable upon contact with one 42 of the opposing lateral edges 42, 44 of the printed circuit board 12. The tapered surface 40 terminates in a thickened section 42 abutting a board edge retention cavity 44 extending along the length of the post 28. When the printed circuit board 12 is mounted within the board edge retention cavities 44, 46, formed in the opposing pair of posts 28, 24, the associated resilient latches 36, 32 return to their nondeflected position to retain the printed circuit board 12 in its mounted contact position, shown in phantom in FIGS. 2 and 3.

Referring back to FIG. 1, each access cavity, 16 for example, includes a plurality of generally parallel, spaced apart, transversely oriented contact slots 46, 48 disposed along substantially its entire length. Connector spring contacts 50, 52 are disposed in the slots 46, 48 respectively. If desired, the right spring contact 50 disposed in the second slot 48 may be electrically short circuited to the left spring contact 52 disposed in the adjacent first slot 46. This may be achieved by forming the adjacent spring contacts 50, 52 in the slots 48, 46 as integral portions of a single electrically conductive metallic strip, the interconnecting portion of which (not shown) would extend along the mounting surface 54 of the elongated base 22 opposite the access side 20 of the base 22. Alternatively, the spring contacts 50, 52 may be electrically insulated from each other by the insulating wafers 56, 58, 60 between the contacts 50, 52 and forming the slots 48, 46 in the housing. Each of the slots, 48 for example, formed by adjacent wafers 58, 60 includes an elongated, inclined insertion wall 62, a bottom edge 64, an inwardly inclined shoulder 66, and a vertically projecting flatted stop wall 68 disposed between the inclined wall 62 and the inclined shoulder 66.

Figure 2:
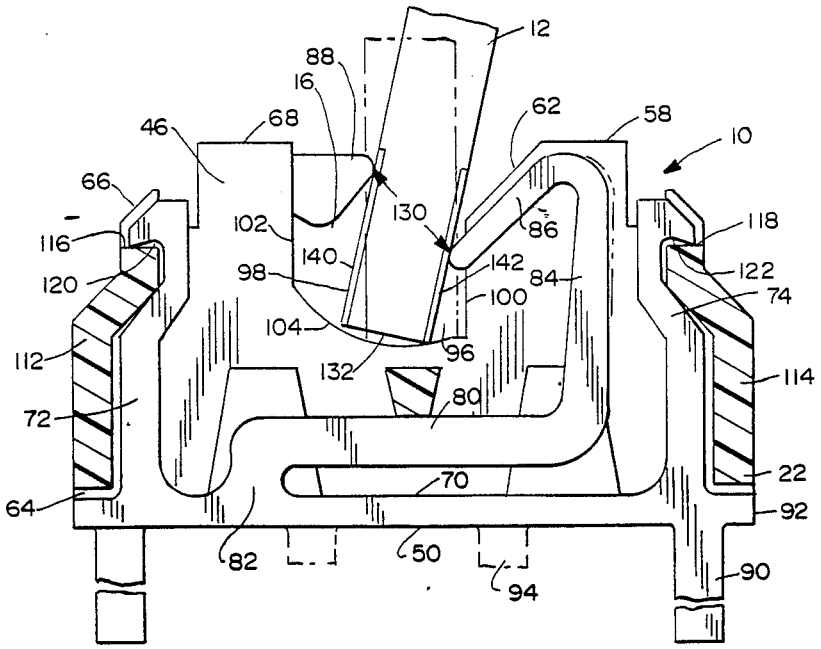
FIG. 2 is a cross-sectional view of the electrical connector of FIG. 1, taken along line 2—2 of FIG. 1, depicting the right contact beam in its free state in the preferred electrical connector.
Figure 3:
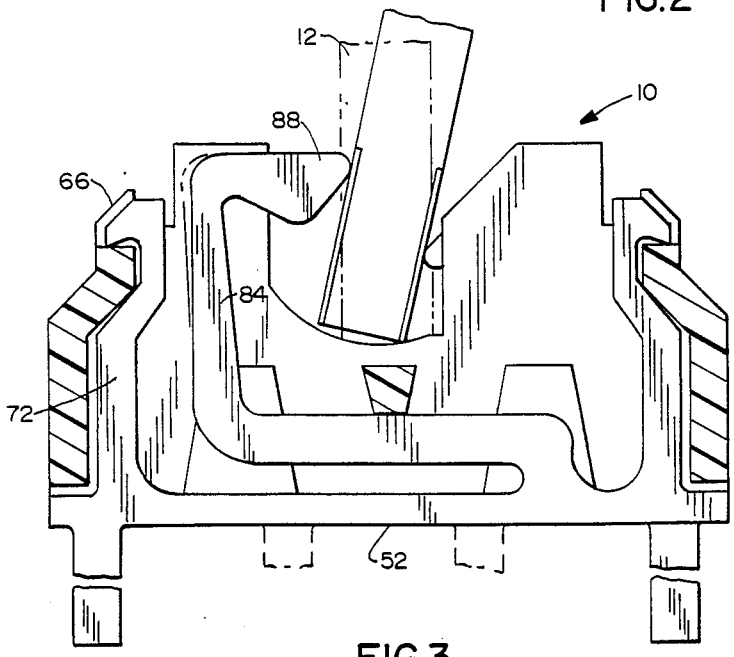
FIG. 3 is a cross-sectional view of the novel electrical connector of FIG. 1, taken along line 2—2 of FIG. 1, depicting the left contact arm in its free state in the preferred electrical connector.

Referring now to FIG. 2, the right spring contact 50 is shown as disposed in the first contact slot 46 of FIG. 1. In FIG. 3, the left spring contact 52 is shown as disposed in the second contact slot 48 of FIG. 1. The contacts 50, 52 are stamped and integrally formed from any suitable resilient electrically conductive metallic materials, preferably from a copper alloy such as strip of beryllium copper phosphor bronze or other suitable material having a thickness of approximately 0.012 inch. The two contacts 50, 52 are, to a large degree, mirror images of each other, and thus the description of one applies to the other with this understanding and the exceptions described below. The right spring contact 50 of FIG. 2, for example, has a transverse support base 70 extending across the width of the first contact slot 46 adjacent bottom edge 64 of the elongated base 22. First and second housing latch arms 72, 74 extend from the opposing ends 76, 78 of the support base 70 towards the opposed inclined shoulders 66, 74. A cantilever contact beam 80 extends from a junction 82 with the support base 70 intermediate the latch arms 72, 74 but adjacent the first or left contact arm 72. The cantilever beam 80 extends from the junction 82 parallel to the support base 70 toward the right latch arm 74. A contact beam 84 extends perpendicularly from the cantilever beam 80 adjacent the right latch arm 74, and an inclined contact arm 86 extends from the end of the contact beam 84 opposite the cantilever beam 80 toward the left latch arm 72 at an acute angle to the contact beam 84. The contact beam 84 narrows in cross-section from the wider intersection with the cantilever beam 80 toward the intersection with the uniformly narrower contact arm 86.

On the side of the support base 70 opposite the cantilever beam 80, a first board contact or lance 90 extends perpendicularly from the base 70 at the right end 92 of the base 70. An optional second board contact or lance 94 may also extend from the support base 70 parallel to the first board contact 90. The board contacts 90, 94 provide electrical and mechanical connection to a base printed circuit board (not shown) when mounted in, and soldered, to the base board in ways well known to those of skill in the art.

As shown in FIG. 3, the left contact 52 has the identical mirror image instruction with one exception. Rather than having an inclined and narrow contact arm 86 as in FIG. 2, the left contact 52 is a thickened contact 88 extending substantially perpendicularly from the contact beam 84.

Referring again to FIG. 2, the first access or mounting cavity 16 has a deep throat 96 for insertion of the contact bearing end 98 of the printed circuit board 12. The throat 96 is bounded on the right side by first planar side edge 100 extending toward and adjoining the inclined insertion wall 62 of the second insulating wafer 58, and on the left side by a second planar side edge 102 extending toward and perpendicularly adjoining the stop wall 68. A rounded throat bottom 104 interconnects the first and second side edges 100, 102. The opposing planar edges 100, 102 extend substantially perpendicularly to the support base 70 of the right contact 50.

A strengthening wall 106 extends perpendicularly from the wafer 58 to rigidly interconnect the wafer 58 with the adjoining wafer 60, as shown in FIG. 1. In addition, molded-in recesses 108, 110 penetrate the bottom edge 64 of the wafer 58 to minimize the material necessary to form the wafer 58 while maintaining sufficient strength in the body of the wafer 58.

In addition, latching ramps 112, 114 also extend perpendicularly from the surface of the wafer 58 to, as also shown in FIG. 1, interconnect the adjacent wafers 58, 60. The latching ramps 112, 114 provide strength and rigidity to the connector 10 and wafers, e.g., 58, while also providing latching surfaces 116, 118 for mating latch clamps 120, 122 on the latch arms 72, 74. Internal inclined ramp surfaces 128, 130 on the ramps 112, 114 urge the mating latch arms 72, 74 inwardly respectively, to center the contact 50 in the access cavity 16 while simultaneously urging the contact 50 to engage the base circuit board (not shown).

As shown in FIGS. 2 and 3, the structure of each wafer 50, 52 is the same. Thus, the contact bearing end 98 of a circuit board 12 is mounted in the connector 10 by inserting the contact bearing end 98 into the deep throat 96 at an acute angle to the parallel planes of the planar side edges 100, 102 of the throat 96, between the mounting gap 130 between the narrow contact arm 86 and thickened contact arm 88 on adjacent right and left contacts 50, 52 respectively. The mounting gap 130 is, at its narrowest point, substantially wider than the width of the insertion edge 132 of the board 12. The board 12 is then rotated into position in the throat 96 so, as shown in phantom, that the opposing sides 140, 142 of the board 12 are parallel to the opposing side edges 100, 102 of the throat 96.

When thus mounted in the throat 96, the narrow contact arm 86 is deflected somewhat toward the right latch arm 74. At the same time, the thickened contact arm 88 on an adjacent contact 52 is deflected, as shown in phantom in FIG. 2, toward the left latch arm 72.

In accordance with an important feature of the present invention, greater contact deflection capability of the contacting portions of the spring contact is inherent in the off-center support of the cantilever beams, which can be significantly lengthened as a result. In addition, because the one-sided contact engages only one side of the board rather than both sides of the board as do traditional C-and U-shaped contacts, the minimum spacing between contacts can be reduced by up to 50% while retaining the same minimum spacing between contact pads on each side of the board.

In this manner, a new and improved zero or low insertion force electrical connector is provided for making effective and reliable high contact force electrical connection with a printed circuit board with the capability of greater beam deflection and the use of existing board tab densities for single or double density connectors. A single density will utilize contact pads on only one side of the board. A double density will utilize pads on both sides of the board. Quad densities are achieved by utilizing pads on both sides of the board, each such pad contacting a separate single-sided contact at the doubled-up spacing allowed by the single-sided contact arms.

Obviously, many modifications and variations of the present invention are possible in light of the above teachings. For example, the precise configuration of the spring contacts 54, 73 may be modified to achieve desired spring and contact characteristics. Thus, it is to be understood that, within the scope of the appended claims, the invention may be practiced otherwise than as specifically described above.

What is claimed is:

1. A low insertion force connector of the type for connecting a first circuit board to a second circuit board, the first circuit board having a board edge, first and second opposed board surfaces abutting the board edge, and at least one board contact on either the first or second opposed board surfaces, the connector comprising in combination:

A. a housing having spacing means for maintaining at least a first and a second contact space in the housing, the spacing means having a board cavity bounded by a first cavity side and an opposing second cavity side;

B. a first contact disposed in the first contact space and having only a first contact arm for engaging the first side of the circuit board and first means for supporting the first contact arm adjacent the first cavity side in the board cavity; and C. a second contact disposed in the second contact space and having only a second contact arm for engaging the second side of the circuit board and second means for supporting the second contact are adjacent the second cavity side in the board cavity;

wherein (1) the first cantilevered beam extends across the width of the first housing cavity bounded by the first housing cavity's sides a first distance defined by the junction of said beam with a terminal support base and the furthest length said first beam can extend toward one of said housing cavity sides; and (2) the second cantilevered beam extends across the width of the second housing cavity bounded by the second housing cavity's sides a second distance defined by the junction of said beam with a terminal support base and the furthest length said second beam can extend toward one of said housing cavity sides; so that (3) the sum of said first distance and said second distance is greater than a distance between said opposite cavity walls either said cavity.

2. The low insertion force connector of claim 1 wherein the first contact arm includes a first cantilevered section supported by the first support means, and a first spring arm extending from the first cantilevered section.

3. The low insertion force connector of claim 2 wherein the first cantilevered section is longer than the width of the board cavity.

4. The low insertion force connector of claim 2 wherein the second contact arm includes a second cantilevered section supported by the second support means, and a second spring arm extending from the second cantilevered section.

5. The low insertion force connection of claim 4 wherein the second cantilevered section is longer than the width of the board cavity.

6. A low insertion force connector of the type for connecting a first circuit board to a second circuit board, the first circuit board having a board edge, first and second opposed board surfaces abutting the edge, and at least one board contact on either the first or second opposed board surfaces, the connector comprising in combination:

A. a housing having at least first and second aligned housing cavities, and first and second aligned contact spaces adjacent the first and second housing cavities, each such cavity being bounded by a first side opposing a second side and a cavity throat intermediate the first side and second side, the housing cavities collectively providing a single circuit board edge cavity in the housing;

B. a first contact disposed in the first contact space and having a first support member, a first cantilevered beam supported by the first support member, and only one spring arm extending from the first cantilevered beam into the first board edge cavity, whereby the spring arm on the first contact can resiliently engage the first surface of the circuit board when the board edge is inserted into the board edge cavity; and C. a second contact disposed in the second contact space and having a second support member, a second cantilevered beam supported by the second support member, and only one spring arm extending from the second cantilevered beam into the board edge cavity, whereby the spring arm contact on the second contact can resiliently engage the second surface of the circuit board when the board edge is inserted into the board cavity;

wherein (1) the first cantilevered beam extends across the width of the first housing cavity bounded by the first housing cavity's sides a first distance defined by the junction of said beam with a terminal support base and the furthest length said first beam can extend toward one of said housing cavity sides; and (2) the second cantilevered beam extends across the width of the second housing cavity bounded by the second housing cavity's sides a second distance defined by the junction of said beam with a terminal support base and the furthest length said second beam can extend toward one of said housing cavity sides; so that (3) the sum of said first distance and said second distance is greater than a distance between said opposite cavity walls of either said cavity.

7. The low insertion force connector of claim 6 wherein: (1) the spring arm on the first contact has (a) a first central resilient section at a substantially right angle to the first cantilevered beam, and (b) a first contact section extending from the first central resilient section into the board cavity adjacent the first side of the first housing cavity; and (2) the spring arm on the second contact has (a) a central resilient section at a substantially right angle to the second contact cantilevered beam, and a second contact section extending from second central resilient section into the board cavity adjacent the second side of the second housing cavity.

8. The low insertion force connector of claim 7 wherein (1) the first central resilient section comprises a first resilient beam and the first contact section is at an acute angle to the axis of the resilient beam, and (2) the second central resilient section comprises a second resilient beam and the second contact section is substantially thicker in cross-section than the first contact section.

9. The low insertion force connector of claim 6, 7, or 9 wherein the support member of at least one contact has latching members adjacent opposing ends of the support member, at least one circuit board lance extending from the side of the support member opposite the cantilevered beam, and the cantilevered beam joins the support member intermediate the opposed first and second latching members.

* * * * *